US005733429A

United States Patent [19]

Martin et al.

[11] Patent Number: 5,733,429

[45] Date of Patent: Mar. 31, 1998

[54] POLYACRYLIC ACID ADDITIVES FOR COPPER ELECTROREFINING AND ELECTROWINNING

[75] Inventors: Sylvia Martin, Shelby Township, Mich.; Neil Nebeker, Kearny, Ariz.

[73] Assignee: Enthone-OMI, Inc., Warren, Mich.

[21] Appl. No.: 711,784

[22] Filed: Sep. 10, 1996

[51] Int. Cl.[6] ..... C25D 1/04; C25C 1/12

[52] U.S. Cl. ..... 205/77; 205/585

[58] Field of Search ..... 205/574, 585, 205/138, 77

[56] References Cited

U.S. PATENT DOCUMENTS

| | | | |
|---|---|---|---|
| 4,181,582 | 1/1980 | Dahms | 205/296 |
| 4,857,159 | 8/1989 | Davis et al. | 306/560 X |
| 5,242,571 | 9/1993 | Sein et al. | 205/138 |

*Primary Examiner*—Donald R. Valentine

*Attorney, Agent, or Firm*—Harness, Dickey & Pierce, P.L.C.

[57] ABSTRACT

Polyacrylic acids are used in electrowinning and electrorefining baths as additives for grain refinement, dendrite reduction, and for reducing impurities in the electroplate.

20 Claims, No Drawings

POLYACRYLIC ACID ADDITIVES FOR COPPER ELECTROREFINING AND ELECTROWINNING

BACKGROUND OF THE INVENTION

The present invention relates to additives for producing fine-grained copper deposits which are substantially free of dendrite nodules and sulfur impurities. More specifically, the present invention relates to polyacrylic acid additives useful in electrowinning and electrorefining of copper.

Electrowinning and electrorefining are methods of purifying and collecting copper for use in wire circuit boards or the like. In electrowinning, copper is plated directly from solution, using insoluble anodes such as lead. In electrorefining, the copper is plated onto a cathode from a soluble copper anode. These processes are known to those skilled in the art and have been in use since the 1800's.

In electrowinning applications, it has long been desirable to provide electrodeposits which do not require further purification. This has been problematic in two respects. First of all, additives commonly in use tend to oxidize on the insoluble lead anodes when they evolve oxygen. This anode phenomenon also leads to lead oxides which flake off during electrolysis. These unwanted particles will then tend to migrate to the cathodes, causing impurities of lead in the copper deposit.

Guar gum has typically been used as a brightening additive for electrowinning. The drawback in using this additive is that it is hard to dissolve into solutions and tends to readily break down in solutions. This creates erratic electroplating results. In electrorefining, the thiourea is often used as an additive. This can result in sulfur co-deposition from the plating residues in the solution. Sulfur then co-deposits as an undesirable impurity in the copper deposit. Therefore, an additive without these disadvantages is desirable.

However, any additive used in electrowinning must also be compatible with solvent extraction of copper from the raw ore and the copper stripping process used in line for replenishing copper to the electrowinning baths. Typically, in order to extract copper from a raw ore, the copper ore is initially dissolved with a sulfuric acid solution. This also leaches many undesirable impurities from the ore. The copper is selectively extracted from the sulfuric acid solution via a solvent—solvent extraction technique. Such techniques are known. In brief, an organic solvent which is not soluble in the aqueous sulfuric acid solution is used. The organic solvent acts to exchange a hydrogen atom to the aqueous solution for a copper atom from the aqueous solution. After this is completed, the organic solvent having the copper ions attached is separated from the aqueous solution, leaving the impurities in the aqueous solution. After separation, the copper must then be stripped from the organic molecule.

Additives, to be useful, must not interfere or hinder this solvent extraction process. This could occur in many ways. If an additive is too surface active, it will interfere with the organic water separation, leading to problems. Many organic molecules may interfere with the kinetics of the exchange reaction, reducing the efficiency thereof. Additionally, copper selectivity over iron is somewhat sensitive in the extraction system. Organic additives must not interfere with the selectivity of copper. Additives also must not interfere with the copper stripping process.

Furthermore, in some baths, calcium from cement containers may leach into the bath solution and interfere with the copper removal process. Thus, it is desirable to provide in such baths a method of preventing the calcium from interfering with the electrowinning or electrorefining process.

Additionally, the formation of dendrites, nodules and nodes are undesirable in electrowinning and electrorefining applications.

As stated above, copper is purified in electrorefining from a bath which consists of an acid copper electrolyte utilizing impure copper anodes. As might be expected, the acid bath contains substantial amounts of impurities after continued operation of the electrorefining process. These impurities are typically supplied by the dissolution of these impure copper anodes during operation. Typically, these impurities include bismuth, arsenic, ferrous sulfate, tellurium, selenium, silver, gold and nickel. Because these baths are run in extremely large commercial quantities, problems in the electrorefining process typically result in extremely large quantities of either unacceptable copper deposits or extremely large reductions in process efficiencies. On the contrary, improvements in such processes typically result in extremely large gains in productivity and output. Thus, even a minor increase in the amount of current which can be applied across the electrodes greatly increases the total output of such an electrorefining plant.

In the past, there have been two ongoing problems with electrorefining baths. With the advent of computer technology and other uses for electrorefined copper, the purity standards have been increased. Additive chemistry presently in place in electrorefining baths is barely adequate to maintain the necessary purity levels. For instance, prior art additives which have been used in these baths have included glue and thiourea compounds. While these additives benefit the baths temporarily, such additives break down quickly and may complex with antimony, bismuth, nickel and/or arsenic which allow these impurities to be co-deposited along with nickels and arsenic in the copper plating product.

The second problem in the past is that as these glues and thioureas break down in the baths, dendritic copper begins to form on the cathodes. Eventually, these dendrites grow as nodules on the cathodes and short out the anode-cathode gap. Once these plates are shorted out, the particular plating on that electrode has ceased and the process has become less efficient. Thus, it has been desirable to provide a brightening additive in these baths which will attenuate dendrite formation and does not tend to complex with impurities in the baths or produce other undesirable results in the bath.

Similar problems may occur in an electrowinning system where the additional requirement is in place for an additive to be compatible with extractive solvents.

In co-pending application Ser. No. 08/656,410, entitled "Alkoxylated Dimercaptans as Copper Additives", filed May 30, 1996, many of these problems have been solved. However, there remains a need to have an inexpensive additive for use with electrowinning and electrorefining additives which improves purity, reduces costs, and is beneficial in baths containing calcium.

SUMMARY OF THE INVENTION

Therefore, in accordance with the present invention, there is provided a method for electrowinning or electrorefining copper from a copper electrolyte. The method includes the steps of providing an electroplating bath, including ionic copper and an effective amount of an additive added to the bath as a polyacrylic acid, and electroplating a copper deposit from the bath onto a cathode.

The polyacrylic acid additives of the present invention provide for advantageous functioning in electrowinning baths. In addition, they are completely stable to the high acid and insoluble anode environment. These additives reduce the cost of running the bath. Additives of the present invention also improve the quality of the deposits from the bath, in that they reduce lead oxide flaking from insoluble anodes. Additives of the present invention also control calcium quantities in such baths by forming a precipitate with calcium. Additionally, the additives produce attractive, pure, fine-grained copper, and are effective for reducing dendritic growths in the cathodes. Additives of the present invention do not interfere with solvent extraction and copper stripping processes used in electrowinning.

DETAILED DESCRIPTION OF THE PREFERRED EMBODIMENTS

In accordance with the present invention, there is provided a method for electrowinning or electrorefining of copper from a standard bath, including new and useful additives therefor. The method, in its broad aspects, includes providing an electrolysis bath, including ionic copper. A bath addition of an effective amount of a polyacrylic acid additive is included in the bath of the present invention. A copper deposit is deposited onto a cathode by electroplating with the additive added to the solution. In the method of the present invention, the preferred additive has the formula:

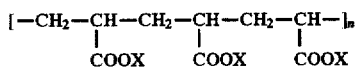

wherein:

n=4–3,000;

X=H, a Periodic Table group 1 or group 2 element salt, an ammonium, salt or mixtures thereof; and X and n are selected such that the additive is bath soluble and compatible with the bath system.

Typically, electrowinning baths of the present invention include sulfuric acid, copper and chlorides in similar amounts as electrorefining baths. However, electrowinning baths typically differ from electrorefining baths in that they may have lower concentrations of copper than that used in electrorefining operations, and they utilize insoluble anodes. Thus, baths in accordance with the present invention are known in the art, and typically are operated in large commercial quantities of from thousands to millions of gallons in size. Typically, electrorefining baths include from about 130 to about 225 grams per liter sulfuric acid, 10 to about 75 grams per liter chloride ions, and typically from about 30 to about 60 grams per liter copper ion concentration. In electrowinning baths, copper is found in amounts of generally from about 10 to about 70 grams per liter, and typically from about 25 to about 50 grams per liter of copper ions. Because the baths are typically obtained from raw copper ores or semi-refined copper ores, the baths contain impurities found in such ores. These impurities may include cobalt or nickel ions, antimony ions, bismuth ions, arsenic ions, ferrous sulfate, tellurium ions, manganese ions, molybdenum ions, selenium ions, gold ions, silver ions, etc. Other impurities may be found in these baths, depending on the sources of the ore and additives which have been used in the bath in the past. Amounts of these and other impurities may vary substantially, depending on the source of the ore. Calcium is also found as an impurity in some baths which are contained in cement vats, where calcium has leached from the cement, or from use of well water.

Polyacrylic acids, in accordance with the present invention, have a molecular weight (weight average) of from about 1,000 to about 650,000 generally, typically from about 2,000 to about 300,000, and preferably from about 20,000 to about 100,000. Depending somewhat upon the size of the additive chosen, the bath may contain from about 2 to about 3,000 milligrams per liter as an effective quantity of the additive, and preferably from about 6 to about 200 milligrams per liter of the additive. In a preferred embodiment, a polyacrylic acid having a molecular weight of about 60,000 is added to the bath in amounts of from about 10 to about 60 milligrams per liter, and preferably about 20 milligrams per liter. Set forth below in Table I are typical concentrations (at addition) for preferred additives of the present invention.

TABLE 1

Preferred polyacrylic Acid Additives

| Molecular Weight | Bath Concentration |
|---|---|
| 2,000 | 200 mg/l |
| 5,000 | 100 mg/l |
| 5,800 | 100 mg/l |
| 20,000* | 60 mg/l |
| 25,000 | 60 mg/l |
| 60,000* | 20 mg/l |
| 240,000 | 10 mg/l |

*Sodium salt

Polyacrylic acids, in accordance with the present invention, may be obtained commercially from many sources. Thus, the polyacrylic acids used herein are conventional and readily known to those skilled in the art. Typically, the larger the molecular weight of the polyacrylic acid additives, the less amount of additive is required, and as the molecular weight of the polyacrylic acid additive approaches the lower end of the range, more additive is required in the bath. Sodium salts of the above additives are particularly preferred when used in the compositions and methods of the present invention.

However, other salts such as ammonium, potassium, magnesium salts, or other group : I or II salts may be used, provided that they do not interfere with the electroplate or the solvent extraction process. The compositions are set forth herein in their additive form, when added to the bath, it is to be appreciated by those skilled in the art, that these additives may disassociate and may be in different forms in the bath themselves.

The polyacrylic acids of the present invention have several benefits in the bath. The first benefit is that the additive allows for production of pure, uniform, fine-grained copper. The next benefit is that, for electrowinning baths, one can typically use lead insoluble anodes without lead impurities. In effect, the additive of the present invention acts to regulate the copper deposition at the cathode, and prevents the anodes from sloughing of oxides into the solution. Lead oxide particles relieved from these anodes tend to migrate to the cathode and provide impurities in the copper plate. Thus, additives of the present invention prevent this substantially from occurring. Additionally, additives of the present invention tend to precipate with any calcium in solution into an insoluble, flocculent-type precipitate which removes the calcium from the solution, preventing calcium from interfering with the process if calcium is present.

Additives of the present invention are compatible with copper solvent extraction processes, since they do not have any surfactant properties which detrimentally affect the process. Additives of the present invention do not harmfully interfere with normal copper iron selection and do not adversely affect normal reaction kinetics. Additives of the present invention also do not harmfully interfere with copper stripping operations.

Additionally, the additives of the present invention are useful in the process of electrowinning of wire directly from an electrowinning bath. Such a process is set forth in U.S. Pat. No. 5,242,571, entitled "Method and Apparatus for the Electrolytic Production of Copper Wire", issued Sep. 7, 1993 to Sein et al, which patent is incorporated herein by reference thereto. The additives of the present invention, when used in electrowinning of wire, are used in accordance with the guidelines set forth above. Additives of the present invention produce fine-grained copper wire at relatively low costs, substantially without harmful levels of lead oxide impurities.

A further understanding of the present invention will be had by reference to the following examples which are set forth herein, for purposes of illustration but not limitation.

EXAMPLE I

An electrorefining electrolyte is analyzed and has the constituents set forth in Table II below.

TABLE II

| Copper Electrorefining Electrolyte | |
|---|---|
| Constituent | Amount |
| Copper Sulfate | 180 g/l |
| Sulfuric Acid | 150 g/l |
| Chloride Ion | 30 mg/l |
| Nickel Ion | 12 mg/l |
| Antimony Ion | 200 mg/l |
| Bismuth Ion | 100 mg/l |
| Arsenic Ion | 6 g/l |
| Ferrous Ion | 9 g/l |
| Tellurium Ion | 150 mg/l |
| and other precious metal impurities | |

To the bath is added 10 mg/l of a sodium salt of a 240,000 MW polyacrylic acid. The bath is operated at 150° F., at 20 amps per square foot cathode current density. The deposit is fine-grained with no dendrites.

EXAMPLE II

A copper electrowinning solution is analyzed to contain the constituents set forth in Table III.

TABLE III

| Copper Electrowinning Electrolyte | |
|---|---|
| Constituent | Amount |
| Copper Metal (from Sulfate) | 45 g/l |
| Sulfuric Acid | 165 g/l |
| Chloride Ion | 30 mg/l |
| Nickel | 7.5 mg/l |
| Iron | 2 g/l |
| All Other Impurities | <500 mg/l |
| Polyacrylic Acid | (60,000 MW) 20 mg/l |

The polyacrylic acid is a molecular weight 60,000 sodium salt polyacrylic acid used in weights of 20 milligrams per liter. The bath is operated at a temperature of 140° F., with cathode current densities of 12 amps per square foot. The resulting electrowinned copper is found to be pure, fine-grained, and to contain substantially no dendrites or lead oxide impurities. The (60,000 MW) sodium salt of polyacrylic acid was tested in an industrial test as follows.

EXAMPLE III 20 ppm of the additive was added into a stripper cell for one week. During the entire test, the sheets from the cell were easy to strip and smoother than control cells using guar gum as the only additive. The sheets were very malleable and very tough when the bend test was applied. A normal sheet from the stripper test breaks after 10 bends. The sheets from the test cell did not break until 15 bends. The current efficiency for the stripper cell was the same as those for the control cells.

The electrolyte with the invention additive from the above tests was tested for phase disengagement, strip kinetics, extraction kinetics and copper iron selectivity in the SXEW ore recovery system. The test was against a normal control using guar gum as the additive. The test results are set forth in Table IV below.

TABLE IV

| | Extract | Strip |
|---|---|---|
| Phase Disengagement | | |
| Control | 52 (s) | 30 (s) |
| Invention 60,000 MW Polyacrylic Acid | 34 (s) | 27 (s) |
| Strip Kinetics | 15 (s) | 30 (s) |
| Control | 84.4% | 97.6% |
| Invention 60,000 MW Polyacrylic Acid | 83.9% | 92.3% |
| Extract Kinetics | 15 (s) | 30 (s) |
| Control | 89.3% | 97.6% |
| Invention 60,000 MW Polyacrylic Acid | 87.2% | 96.4% |
| Copper Iron Selectivity | | |
| Control | 8000 | |
| Invention 60,000 MW Polyacrylic Acid | 6100 | |

Although the numbers for the invention is lower than the control, it is well in spec.

EXAMPLE V

There were two tests performed using (60,000 MW) sodium salt of polyacrylic acid as a leveling agent into a pair of industrial cells. The cells were harvested about 20 days apart and compared against control cells not using the PAA additive. The cell in each case was compared with the adjacent cell. The test cells were smoother and the sulphur analysis was at 9 ppm for each pull. The adjacent all sulphur analysis was at 12 ppm. The trace metal analysis was very good for the test cells and for the control cell. The current efficiency for the cell on the first pull was 90.6% and the second pull was 92.4%. The average for the controls was 89.7% and 88.3%. The average current density for each pull was 16.4 and 18.75 amps per square foot, respectively.

The polyacrylic acid was found to be easier to get into solution than the guar gum, is less expensive, more stable, and should provide better control of the process.

EXAMPLE VI

A test was run for evaluating the (60,000 MW) sodium salt of polyacrylic acid as a leveling agent. All lab tests were at 16 amps per square foot. The test used 5, 10 and 20 ppm of the sodium salt of polyacrylic acid additive. The 20 ppm seemed to be the best. All products were very smooth and very malleable compared to control using guar gum.

These were lab tests with one cell having plant electrolyte using guar gum being pumped through the cell and the other cell had electrolyte with the (60,000 MW) sodium salt of polyacrylic acid. The power for the cells was in series, so each cell received the same current. The electrolyte was pumped from a 20 liter receiver to the cell, back to the receiver. The temperature of each cell was at 110° F.

The anodes were lead anodes from the tankhouse and the cathodes were stainless steel. The plating time was 4 hours. The additive was found to provide good leveling and did not contain lead oxide in its deposit.

EXAMPLE VII

Bath additives as set forth in Table V are used in electrowinning applications.

TABLE V

| Bath Amounts | Molecular Weights of Polyacrylic Acid |
|---|---|
| 200 mg/l | 2,100 |
| 100 mg/l | 5,100 |
| 100 mg/l | 5,800 |
| 60 mg/l | 20,000 sodium salt |
| 60 mg/l | 28,000 |
| 20 mg/l | 60,000 sodium salt |
| 10 mg/l | 240,000 |

These additives are found to produce good deposits and to prevent co-deposition of lead oxide nodules in the electrowinning materials produced.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

What is claimed is:

1. A method for electrowinning or electrorefining of copper from a copper electrolysis bath comprising:

providing a copper electrolysis bath including ionic copper and an addition of an effective amount of a polyacrylic acid additive for controlling dendrite formation;

said additive having at least one COOX moiety wherein X=H, a Periodic Table group 1 or group 2 element salt, ammonium salt or mixtures thereof; and electroplating a copper deposit from said bath onto a cathode.

2. The method of claim 1 wherein the additive has the formula:

$$[-CH_2-\underset{\underset{COOX}{|}}{CH}-CH_2-\underset{\underset{COOX}{|}}{CH}-CH_2-\underset{\underset{COOX}{|}}{CH}-]_n$$

wherein:

n=4–3,000;

X=H, a Periodic Table group 1 or group 2 element salt, ammonium salt or mixtures thereof; and X and n are selected such that the composition is bath soluble and compatible with the bath system.

3. The method of claim 2 wherein X is sodium.

4. The method of claim 1 wherein the polyacrylic acid has a weight average or number average molecular weight of from about 1,000 to about 650,000.

5. The method of claim 1 wherein the polyacrylic acid has a weight average or number average molecular weight of from about 2,000 to about 300,000.

6. The method of claim 1 wherein said bath contains from about 2 to about 3,000 mg/l of said additive.

7. The method of claim 1 wherein said bath contains from about 6 to about 200 mg/l of said additive.

8. A method for electrowinning or electrorefining of copper from a copper electrolysis bath comprising:

providing a copper electrolysis bath including an electroplating amount of ionic copper;

adding a polyacrylic acid additive material to the bath, where the polyacrylic acid has the formula:

$$[-CH_2-\underset{\underset{COOX}{|}}{CH}-CH_2-\underset{\underset{COOX}{|}}{CH}-CH_2-\underset{\underset{COOX}{|}}{CH}-]_n$$

wherein:

n=4–3,000;

X =H, a Periodic Table group 1 or group 2 element salt, ammonium salt or mixtures thereof; and X and n are selected such that the composition is bath soluble and compatible with the bath system;

and electroplating copper deposit from said bath onto a cathode.

9. The method of claim 8 wherein the polyacrylic acid has a weight average or number average molecular weight of from about 1,000 to about 650,000.

10. The method of claim 8 wherein the polyacrylic acid has a weight average or number average molecular weight of from about 2,000 to about 300,000.

11. The method of claim 8 wherein said bath contains from about 2 to about 3,000 mg/l of said additive.

12. The method of claim 8 wherein said bath contains from about 6 to about 200 mg/l of said additive.

13. The method of claim 8 wherein X is sodium.

14. A method for electrowinning or electrorefining of copper from a copper electrolysis bath comprising:

providing an electrorefining or electrowinning bath containing an electroplating amount of ionic copper;

adding an effective amount of a sodium salt of polyacrylic acid for controlling dendrite formation having a molecular weight of from about 20,000 to about 100,000 to the bath; and electroplating a copper deposit from said bath onto a cathode.

15. A method for electrowinning of copper wire from a copper electrolysis bath comprising:

providing a copper electrolysis bath adapted for producing wire by electrowinning, said bath including ionic copper and an addition of an effective amount of a polyacrylic acid additive for controlling dendrite formation; and electroplating a copper wire product from said bath onto a cathode.

16. The method of claim 15 wherein the additive has the formula:

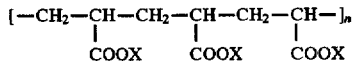

wherein:

n=4–3,000;

X=H, a Periodic Table group 1 or group 2 element salt, ammonium salt or mixtures thereof; and X and n are selected such that the composition is bath soluble and compatible with the bath system.

17. The method of claim 15 wherein the polyacrylic acid has a weight average or number average molecular weight of from about 1,000 to about 650,000.

18. The method of claim 15 wherein the polyacrylic acid has a weight average or number average molecular weight of from about 2,000 to about 300,000.

19. The method of claim 15 wherein said bath contains from about 2 to about 3,000 mg/l of said additive.

20. The method of claim 15 wherein said bath contains from about 6 to about 200 mg/l of said additive.

* * * * *

UNITED STATES PATENT AND TRADEMARK OFFICE

CERTIFICATE OF CORRECTION

PATENT NO. : 5,733,429
DATED : March 31, 1998
INVENTOR(S) : Sylvia Martin and Neil Nebeker It is certified that error appears in the above-identified patent and that said Letters Patent is hereby corrected as shown below:

Title page

Under Assignee, after "Mich.", insert --, and ASARCO Incorporated, New York, NY --

Signed and Sealed this

Twentieth Day of November, 2001

*Attest:*

Nicholas P. Godici

NICHOLAS P. GODICI

*Attesting Officer*

*Acting Director of the United States Patent and Trademark Office*